US005839236A

United States Patent [19]

Frey

[11] Patent Number: 5,839,236

[45] Date of Patent: Nov. 24, 1998

[54] CURTAIN WALL INTEGRAL DRIP SYSTEM

[75] Inventor: John R. Frey, Riverside, Calif.

[73] Assignee: International Aluminum Corporation, Monterey Park, Calif.

[21] Appl. No.: 871,631

[22] Filed: Jun. 9, 1997

[51] Int. Cl.[6] ..... E04B 1/66

[52] U.S. Cl. ..... 52/235; 52/302.1; 52/469

[58] Field of Search ..... 52/209, 235, 302.1, 52/204.62, 204.7, 461, 469

[56] References Cited

U.S. PATENT DOCUMENTS

| | | | |
|---|---|---|---|
| 2,963,126 | 12/1960 | Cudini | 52/235 X |
| 3,866,369 | 2/1975 | Paull . | |
| 4,055,923 | 11/1977 | Biebuyck | 52/209 X |
| 4,276,729 | 7/1981 | Shiga et al. . | |
| 4,644,717 | 2/1987 | Biebuyck . | |
| 4,672,784 | 6/1987 | Pohlar | 52/209 X |
| 4,852,312 | 8/1989 | Harbom | 52/209 X |
| 5,452,552 | 9/1995 | Ting | 52/235 |
| 5,598,671 | 2/1997 | Ting | 52/302.1 X |

FOREIGN PATENT DOCUMENTS

| | | |
|---|---|---|
| 0548773 A1 | of 0000 | European Pat. Off. . |
| 2131072 | of 0000 | United Kingdom . |
| 2167099 | of 0000 | United Kingdom . |
| 861538 | of 0000 | United Kingdom . |
| 896420 | of 0000 | United Kingdom . |

OTHER PUBLICATIONS

Kawneer 2250 Wall Installation Instructions Material, Feb. 1992 pp. 1–25.

*Primary Examiner*—Christopher Kent
*Assistant Examiner*—Timothy B. Kang
*Attorney, Agent, or Firm*—William W. Haefliger

[57] ABSTRACT

An integral drip system for thermally isolated straight in glazed curtain wall or window wall which will restrict water penetration into a building. The drip system includes at least one flange included for easy glazing replacement. This drip system reduces the number of parts required to assemble curtain wall or window wall systems.

6 Claims, 3 Drawing Sheets

4
1
6
5
1
6
8
2
6
7
8
8
2
2
7
6
3
4
6
8
7
3
6

CURTAIN WALL INTEGRAL DRIP SYSTEM

BACKGROUND OF THE INVENTION

1. Field of Invention

This invention relates generally sealing or flashing of thermally isolated straight in glazed curtain wall or window wall systems and more specifically to the thorny and recurring problem of water intrusion to the inside of a building which uses a thermally isolated straight in glazed curtain wall and window wall system. This invention will simplify and improve the sealing process during assembly of a thermally isolated straight in glazed curtain wall or window wall system.

2. Description of Prior Art

In recent years thermal efficiency has become more important in the design of buildings, and thus thermal improvements have been made to the exterior envelopes of buildings. Among these improvements is a thermally isolated straight in glazed curtain wall or window wall system. These systems typically have inside and outside components connected with thermoset plastic clips. The clips are generally spaced far enough apart so that the inside and outside components are effectively isolated from each other and thus create an air gap that will help reduce thermal conductivity through the curtain wall or window wall system. These systems inherently have a flaw in that the air gap also allows rain water to travel through the air gap and sometimes inside the plane of the glazing material and thus to the interior of the building. This of course is failure of the curtain wall or window wall system and is costly to correct. Prior to the thermally isolated systems curtain wall or window wall systems typically consisted of thermally improved systems that either consisted of face caps with gaskets applied with screws to the interior components thus creating a thermal bridge or thermally broken systems consisting of two pieces of a thermally conductive material, such as aluminum, separated by a thermal resistant material. These thermally improved systems do not have the thermal efficiency of a thermally isolated system required in today's energy efficient buildings.

Generally a thermally isolated straight in glazed curtain wall or window wall system typically consists of a skeletal structure consisting of horizontal and vertical components which provide structural integrity to the system and support for a glazing material. The glazing material is held to the skeletal structure using horizontal and vertical face caps applied from the outside using a thermally isolating connecting clip. A thermally isolated straight in glazed curtain wall or window wall system is generally well known to require a secondary seal or flashing that must redirect any water that may have a chance to penetrate the interior plane of a glazing material. One approach to dealing with this water intrusion problem is shown in prior art as a full length water diverter used by Kawneer on their 2250 LR Wall. In this design a water diverter is placed horizontally full length along the top of the glazing material. Besides being costly and difficult to seal along the edges this design has the disadvantage of possibly tilting to the interior if it is placed on the glazing incorrectly. It is difficult and very critical to completely seal the end joints to the verticals so that any trapped water will not run to the interior of the plane of a glazing material. This design also has the disadvantage of shrinkage associated with a thermoplastic material which may cause a break in the seal after installation. In another approach illustrated in prior art by Vistawall's HP 225 system, water intrusion was prevented by adding a full length flashing to the horizontal components of the skeletal structure. This has the disadvantage of requiring notching around miscellaneous parts located on the horizontal components in that area of a thermally isolated straight in glazed skeletal structure. This also is very difficult to seal since there is sealing required around each miscellaneous part and vertical components of a thermally isolated straight in glazed structure. Another approach to this problem is shown in prior art in U.S. Aluminum's thermo-set system where the flashing is located under the clips but above the glass. This has the advantage of always tilting outward since it located off the glazing material and not requiring as much notching since it is under most of the parts in this area. This design still incorporates a component which requires assembly during installation and thus a possible mode of failure if the piece is left off during assembly. This design has the disadvantage of being hard to remove since the glazing material is used as the fulcrum to pry the face caps of the skeletal structure. This may damage existing glazing material. This design also has the disadvantage of shrinkage associated with a thermoplastic material which may cause a break in the seal after installation.

There is a need therefore for a thermally isolated straight in glazed system having a drip system that is integral to a skeletal structure which is reliable and relatively easy to assemble.

OBJECTS AND SUMMARY OF THE INVENTION

The primary object of this invention is to provide a method of diverting water to the exterior plane of a glazing material in a thermally isolated straight in glazed curtain wall or window wall system. This invention accomplishes this with an integral appendage located on a horizontal component of a thermally isolated straight in glazed system.

A further object of this invention is to eliminate extraneous parts required to properly flash a thermally isolated straight in glazed curtain wall or window wall system.

A further object of this invention is to reduce the field assembly costs by reducing the time and materials spent sealing any extraneous parts to a skeletal structure of a thermally isolated straight in glazed curtain wall or window wall system.

A further object of this invention is to provide a method of diverting water to the exterior plane of a glazing material with an integral appendage so that there is no movement between the drip system and skeletal structure due to differing shrinkage rates or thermal expansion rates due to material properties.

A further object of this invention is to continue to allow for easy disassembly if a system has to be reglazed. This is accomplished by providing an appendage parallel to the glazing plane which would allow for prying underneath a horizontal face cap and removing the face cap from any connecting clips.

DESCRIPTION OF THE EMBODIMENT SHOWN IN FIG. 1.

Item 1 comprises the head, a horizontal component of the skeletal structure. Item 2 comprises the horizontal mullion component of the skeletal structure. Item 3 comprises the sill, a horizontal component of the skeletal structure. Item 4 comprises the jamb, a vertical component of the skeletal structure. Item 5 comprises the mullion, a vertical component of the skeletal structure. Item 6 comprises the horizontal component of the face cap system. Item 7 comprises the vertical component of the face cap system. Item 8 comprises the glazing material.

DESCRIPTION OF THE EMBODIMENT SHOWN IN FIG. 2.

Figure 1:
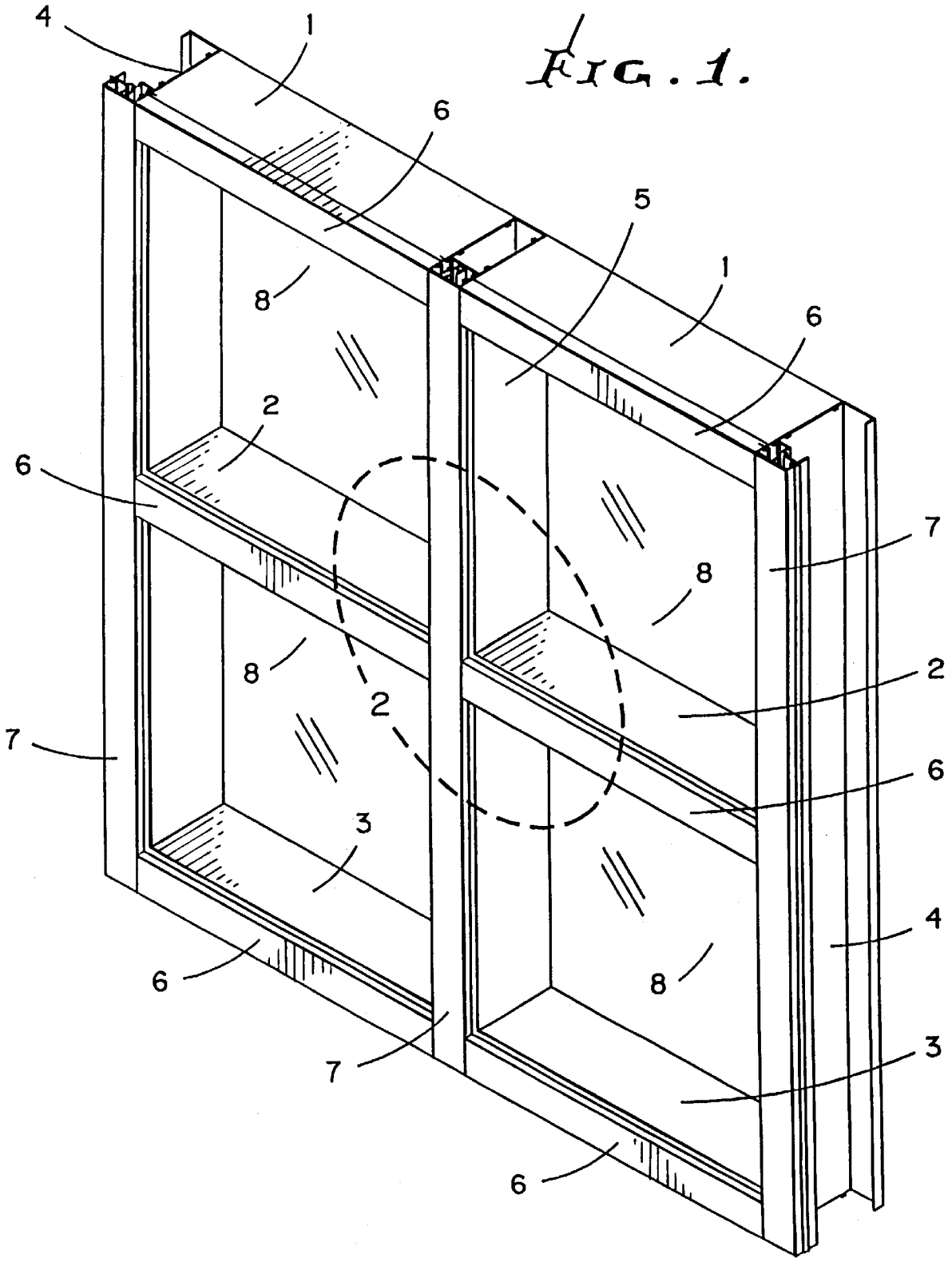
FIG. 1 is an isometric view of the assembled skeletal structure and face caps.
Figure 2:
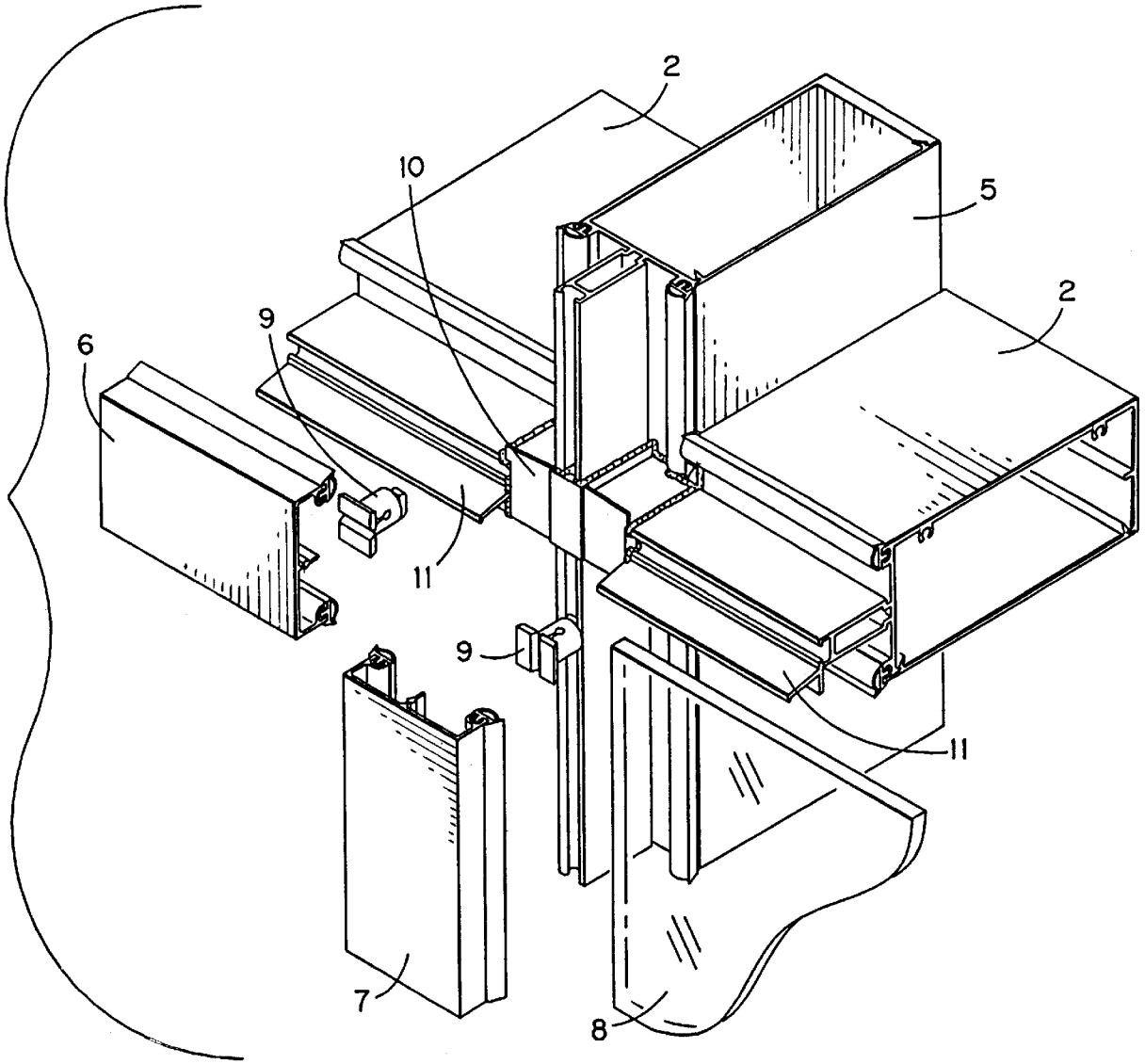
FIG. 2 is an exploded isometric detail view of the skeletal structure and face caps.

Referring to FIG. 2 the embodiment discloses an integral drip system. Item 11 comprises the integral drip system. Item 2 comprises the horizontal mullion component of the skeletal structure. Item 5 comprises the vertical mullion component of the skeletal structure. Item 6 comprises the horizontal component of the face cap system. Item 7 comprises the vertical component of the face cap system. Item 9 comprises the clip that secures the face cap system against the glazing material. Item 10 is a water diverter used to fill a void on a vertical mullion between horizontal mullions. Item 8 comprises the glazing material.

DESCRIPTION OF THE EMBODIMENT SHOWN IN FIG. 3.

Figure 3:
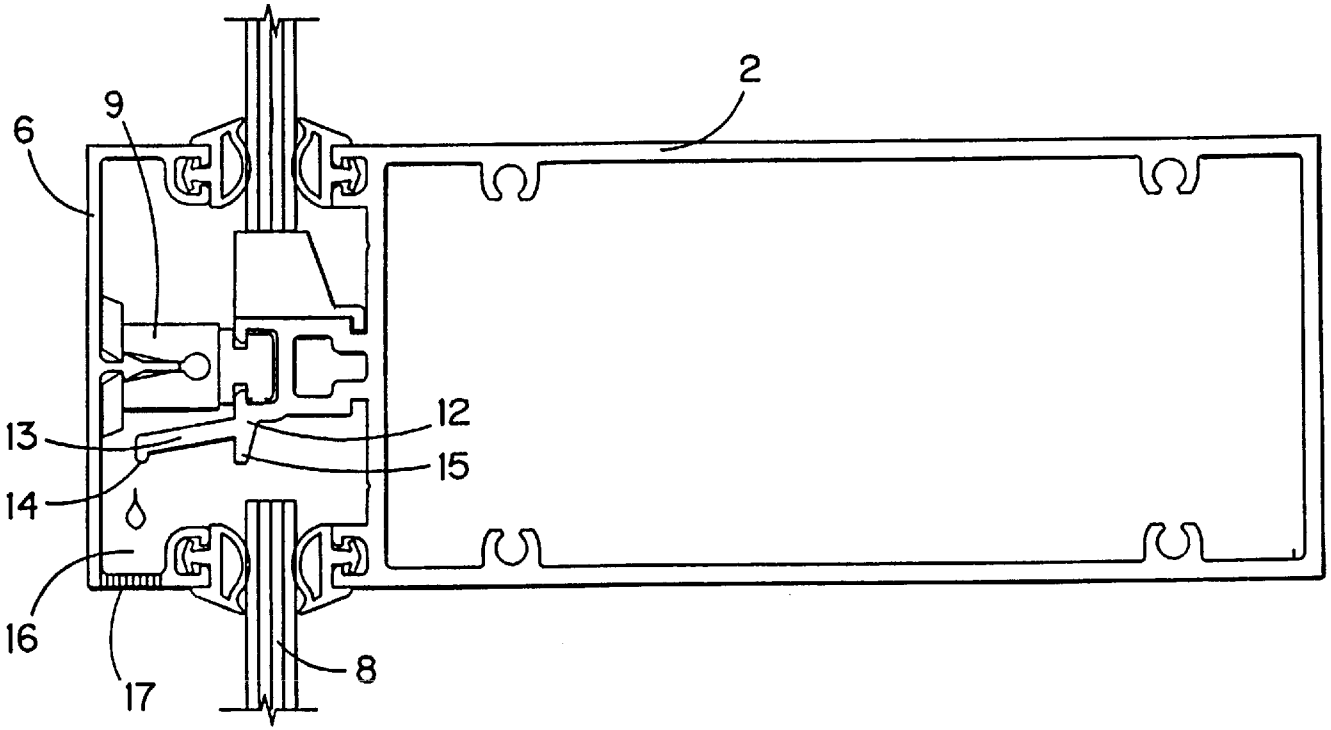
FIG. 3 is a longitudinal sectional view of the assembled horizontal skeletal section and face cap.

Referring to FIG. 3 the embodiment discloses the integral drip system with an easy removal appendage. This integral drip system is comprised of a vertical leg shown in item 12 for attachment of the diverter leg shown in item 13 which is sloped downward to direct any water to the exterior plane of the glazing material shown in item 8. Item 14 shows a drip leg provided to prevent water travel under the diverter leg. Item 14 is located directly over a water trough shown in item 16 which will trap any water off the integral drip system. Item 17 shows voids which allows water to drain out of the water trough of item 16. Item 15 comprises a vertical appendage for easy removal of a face cap.

As disclosed herein, as in the drawing and specification, the apparatus may be further characterized as follows:

It is usable in a thermally isolated straight in glazed curtain wall or window wall system, wherein the curtain wall or window wall system includes a skeletal structure providing structural support for the glazing material, and a face mount capping system to secure the glazing material to the skeletal structure, the skeletal structure including a horizontal mullion, such apparatus comprises:

a) attachment structure integral with the mullion, the capping system having clip attachment to the attachment structure to secure the capping system against the glazing material, b) a drip-directing system carried by the attachment structure and having a drip-receiving, upper surface that slopes sidewardly and downwardly to receive water drippage, and that directs drip water toward the exterior side of a vertical plane defined by the glazing material, c) the cap system defining a trough located to receive water draining off the drip-receiving upper surface, there being voids to drain water from the trough.

The surface typically extends directly beneath the clip attachment, as shown in FIG. 3.

Further, the drip-directing system includes a flange sloping toward the exterior and downwardly, the flange defining the drip-receiving upper surface, the flange and attachment structure being unitary and metallic.

Also, the apparatus includes an appendage that is unitary with the flange and projects downwardly to allow easy removal of the face cap system.

I claim:

1. An integral drip system in combination with a thermally isolated straight in glazed curtain wall or window wall system wherein the curtain wall or window wall system includes a skeletal structure providing structural support of a glazing material and a face mount capping system so that said glazing material may be secured to said skeletal structure, said drip system comprised of a flange with an appendage, said appendage aligned generally parallel to said glazing material supported by said skeletal structure of a thermally isolated straight in glazed system, said appendage extending downward from said flange which projects to the exterior of said skeletal structure, said appendage protruding at an acute angle from the said flange, said appendage extending at the exterior side of said glazing material and being openly exposed to a weep area of said face mount capping system, and wherein said weep area is comprised of a water trough and voids located in the lower portion of the face mount capping system and is everywhere spaced from said glazing material, said voids located to allow water to drain to the exterior of said wall system.

2. An integral drip system in combination with a thermally isolated straight in glazed curtain wall or window wall system, a) said system including an appendage aligned generally parallel to a glazing material supported by a skeletal structure of said wall system, b) a flange projecting away from the glazing material, c) a said appendage everywhere located to the exterior of the glazing material, and connected to the flange and projecting downwardly from the flange in spaced relation to the glazing material, d) there being a capping system for said curtain wall or window wall system, said capping system having a trough with void means, below outermost an extent of the flange.

3. A drip directing system and a thermally isolated straight in glaze curtain wall or window wall system, wherein the curtain wall or window wall system includes a skeletal structure providing structural support for the glazing material, and a face mount capping system to secure the glazing material to the skeletal structure, the skeletal structure including a horizontal mullion, the combination comprising:

a) attachment structure integral with the mullion, the capping system having clip attachment to the attachment structure to secure the capping system to the glazing material, b) said drip-directing system carried by the attachment structure and having a drip-receiving upper surface that slopes sidewardly and downwardly to receive water drippage and to direct drip water toward the exterior side of a vertical plane defined by the glazing material, c) the cap system defining a trough located to receive water draining off the drip-receiving upper surface, there being voids to drain water from the trough, d) said trough and voids spaced at a substantial distance from the glazing material and received within the capping system.

4. The system of claim 3 wherein said drip-directing system includes a flange sloping toward said exterior and downwardly, said flange defining said surface, said flange and attachment structure being unitary and metallic.

5. The system of claim 4 including an appendage that is unitary with said flange and projects downwardly to allow easy removal of said face cap system, said flange having a terminal, said appendage spaced from said terminal.

6. The system of claim 3 wherein said surface extends directly beneath said clip attachment.

* * * * *